US007032420B2

(12) United States Patent
Bourgon et al.

(10) Patent No.: US 7,032,420 B2
(45) Date of Patent: Apr. 25, 2006

(54) METHOD FOR REAL-TIME ADJUSTMENT OF A PLANISHER

(75) Inventors: Jacques-Yves Bourgon, Metz (FR); Olivier Guillard, Metz (FR); Fabrice Tondo, Vitry sur Orne (FR); Olivier Madelaine-Dupuich, Metz (FR); Pierre Lemoine, Rebenacq (FR)

(73) Assignee: Usinor, Puteaux (FR)

( * ) Notice: Subject to any disclaimer, the term of this patent is extended or adjusted under 35 U.S.C. 154(b) by 83 days.

(21) Appl. No.: 10/451,542

(22) PCT Filed: Dec. 14, 2001

(86) PCT No.: PCT/FR01/03992

§ 371 (c)(1),
(2), (4) Date: Nov. 10, 2003

(87) PCT Pub. No.: WO02/051563

PCT Pub. Date: Jul. 4, 2002

(65) Prior Publication Data

US 2004/0069035 A1 Apr. 15, 2004

(30) Foreign Application Priority Data

Dec. 27, 2000 (FR) ..... 00 17085

(51) Int. Cl.
*B21D 1/02* (2006.01)

(52) U.S. Cl. ..... 72/11.7; 72/164; 72/11.1

(58) Field of Classification Search ..... 72/11.1, 72/8.3, 9.1, 11.7, 164, 160, 131
See application file for complete search history.

(56) References Cited

U.S. PATENT DOCUMENTS

| | | | | |
|---|---|---|---|---|
| 3,180,122 | A * | 4/1965 | Evans et al | 72/11.5 |
| 3,416,340 | A * | 12/1968 | Reesor | 72/11.7 |
| 3,429,163 | A * | 2/1969 | Munchbach | 72/131 |
| 3,439,517 | A | 4/1969 | Munchbach | |
| 4,768,363 | A | 9/1988 | Yamashita et al. | |

* cited by examiner

*Primary Examiner*—Daniel C. Crane
(74) *Attorney, Agent, or Firm*—Sughrue Mion, PLLC

(57) ABSTRACT

A method for real-time adjustment of a planisher for planishing metal strip. After a planished strip has been cut into a plate, the method includes measuring the plate at the output of the planisher outside a support zone, correcting the measurement so as to eliminate the influence due to self-weight of the plate, and correcting, as the case may be, the clamping of rollers located at the planer output so as to obtain a plate with a controlled curve.

8 Claims, 2 Drawing Sheets

METHOD FOR REAL-TIME ADJUSTMENT OF A PLANISHER

The present invention relates to a method for adjusting in real time a planisher which is to planish metal strips in reel form or in coil form, such as steel strips, or, directly, plates or sheets.

The invention is applicable, on the one hand, to the planishing of metal strips that are to be cut at the outlet of the planisher in order to obtain plates or sheets of a determined length L and, on the other hand, to the planishing of plates or sheets.

A metal strip or a plate undergoes various operations, such as hot-rolling or cold-rolling, that are intended to confer on it homogeneous dimensional characteristics over its entire length; thus, a rolled metal strip theoretically has a constant thickness and width throughout.

However, the operation of rolling is not sufficient to obtain a strip free from defects. The strip may exhibit flatness defects, such as undulations at the edges or the centre, and a bend (that is to say, a curvature) over the length or width of the strip.

These flatness defects are corrected by planishing the strip in a planisher. Such a planisher is constituted by two stacked cassettes each supporting several motorised rollers which are offset relative to one another and arranged alternately above and below the path of the strip. In the case of a reel of metal strip, the strip is first of all unwound from the reel and generally straightened in a straightening device before undergoing the planishing operation. In order to supply products meeting the flatness criteria required by manufacturers, the planished strips are not rewound onto reels, because winding onto reels destroys the flatness. They are therefore cut at the outlet of the planisher in such a manner as to obtain plates, sheets or blanks, either by means of guillotine shears or by means of follower, rotary or flying shears. The planished plates or sheets are then transported to a stacker and are stacked while awaiting delivery.

The planishing proper is effected by passing the strip or the plate between the offset rollers of the planisher, the clamping of which rollers at the inlet, that is to say, the spacing of the upstream rollers of the planisher, and at the outlet, that is to say, the spacing of the downstream rollers of the planisher, is adjusted. At the inlet of the planisher the residual stresses of the strip are homogenised and the flatness defects, such as undulations and bending over the width, are thus remedied. At the outlet of the planisher, the bending over the length of the strip is treated. For greater clarity in the rest of the text, simply the word "bend" will be used to mean "bend over the length".

The adjustment of the clamping parameters at the inlet and the outlet of the planisher is effected each time a reel, plate (or sheet) is changed, in order to adapt those parameters not only to the dimensional characteristics and to the types of defect of the strip or the plate but also as a function of the bend, depending on the form which it is desired to impart to the plate (or the sheet) after planishing.

Depending on the purpose for which the manufacturers intend to use the planished plates (or sheets), or depending on the type of installation which those manufacturers possess, the plates are delivered with a zero bend (absolutely flat plate), a positive bend or a negative bend.

First of all, the clamping of the inlet rollers of the planisher is adjusted in accordance with methods known per se, and then the clamping of the outlet rollers is adjusted.

A known means of adjusting the outlet rollers of the planisher consists in checking the residual bend of the plate (or sheet) after planishing. For that purpose, the plate is lifted by means of a lifting device in such a manner that the plate is suspended by one or two support points, and then an operator measures the bend of the plate by determining the pitch at the centre of the plate by means of a ruler. The operator can then adjust the setting of the clamping of the rollers at the outlet in order to correct the bend of the plate and to adapt it to the manufacturer's requirements. This measuring operation is repeated as many times as necessary at each change of product (in the form of a reel, plate or sheet).

That technique has the following various disadvantages:

- measurement of the bend of a plate at the change of a product and the adaptation of the clamping of the outlet rollers by the operator makes it necessary to stop the planishing line during that operation, which leads to a loss in productivity;
- some planishing lines are compact, and it is not always possible to install a device for lifting the plates; in that case the bend of the plate is measured away from the line with an even greater line stoppage time;
- the operation of lifting the plate may comprise safety risks for the operator, especially in the case of large plates (more than 2 m in length).

In addition, although the dimensional characteristics of a strip of a given reel are constant over its entire length, the same is not true of the mechanical characteristics. The variations in the mechanical characteristics of a strip have a negative impact on the control of the final bend of the plates after the strip has been planished. Since the clamping of the rollers at the outlet of the planisher has been adjusted for a given mechanical characteristic of the strip, that clamping, in the course of the planishing operation, will no longer be suitable if the mechanical characteristics of the strip vary to a considerable extent.

The control of the residual bend of the plate is an important operation to the extent that the tolerances required by manufacturers in relation to the dimensions and the bend of the plate are becoming increasingly narrow. By way of example, at present, tolerances in relation to the bend of plates intended for LASER cutting, and for some motor vehicle applications, such as connecting pieces, are often less than ±3 mm/m. The object of the present invention is to overcome the disadvantages of the method used in the prior art.

The invention therefore relates to a method for adjusting in real time a planisher that is to planish metal strips, plates or sheets, characterised in that:

- after the strip has been planished, it is cut to obtain a plate or a sheet;
- the curvature of the plate resulting either from the planishing of the cut strip or from the planishing of the plate is measured at the outlet of the planisher outside a support region;
- the measurement is corrected in such a manner as to eliminate the influence attributable to the dead weight of the plate; and
- if necessary, the clamping of the rollers located at the outlet of the planisher is corrected in such a manner as to obtain a plate having a controlled bend.

According to other preferred features of the invention:

- the measurement of the residual bend of the planished plate is effected on the basis of a measurement of the curvature of the plate at the outlet of the planisher outside the support region, the measurement being effected by means of at least three distance sensors;

the measurement of the residual bend of the planished plate is deduced from the measured curvature and the inherent curvature of the planished plate.

The invention relates also to a planishing installation of the type comprising a planisher for planishing metal strips, plates or sheets, characterised in that it comprises means for cutting the strip, after planishing, into planished plates or into planished sheets, means for measuring the residual bend of the planished plates or planished sheets resulting either from the planishing of the cut strip or from the planishing of the plate or the sheet, at the outlet of the planisher, and means for modifying the clamping of the rollers located at the outlet of the planisher as a function of the information provided by the means for measuring the residual bend.

According to other features of the invention:

the means for measuring the residual bend comprise at least three distance sensors, such as optical distance sensors, or eddy current distance sensors;

the planishing installation comprises automatic means for adjusting the clamping of the outlet rollers as a function of the information provided by the distance measurements of the sensors;

the curvature of the planished plate is measured at the said planished plate outside a support region.

As will have been appreciated, the invention consists in performing a measurement in real time of the bend of the plate or of the strip cut to form a plate on leaving the planisher, and in regulating the clamping of the rollers as a function of the results of that measurement.

The features and advantages of the invention will emerge on reading the following description which is given by way of example and with reference to the appended drawings in which.

Figure 1:
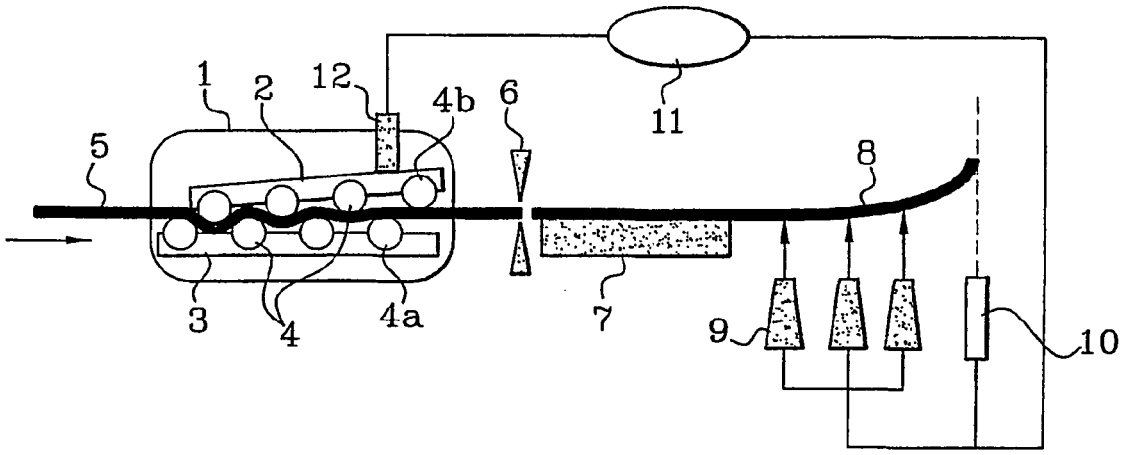
FIG. 1 is a diagrammatic view in cross-section of a planisher.

FIG. 1 shows diagrammatically a planisher 1 comprising two stacked cassettes 2, 3 supporting motorised rollers 4 which are positioned in an offset manner relative to one another and between which a metal strip 5, a plate or a sheet passes. The installation comprises cutting means 6 located at the outlet of the planisher, a transport table 7, a means for conveying the strip cut into plates (which means is not shown in the Figure). In the case of planishing strips, the installation comprises cutting means 6 located at the outlet of the planisher. Of course, the cutting means 6 are superfluous when plates or sheets are being planished directly; however, they may be present in the installation and in that case they are not caused to operate. Shown at 8 is the plate or the sheet (resulting either from the shearing of the strip after planishing or from the planished plate or sheet), one portion of which is supported on the table 7 and the other portion of which projects beyond the table 7. Distance sensors placed, in our diagram, below the region of the planished plate 8 not supported by the table 7, are connected to a system 11 for adjusting the clamping of the rollers 4*a* and 4*b* located at the outlet of the planisher, which system is itself connected to an actuator 12 for regulating the clamping at the outlet (rollers 4*a* and 4*b*).

The metal plate or strip 5 is planished in the planisher 1 by passing between the rollers 4. At the outlet of the planisher, the strip 5 is sheared by the cutting means 6, which are constituted either by guillotine shears or by rotary, follower or flying shears, in such a manner as to obtain plates 8, sheets or blanks having a length L determined in advance. One portion of the planished plate 8 rests on the transport table 7 while a length of plate L' determined in advance by a detection cell 10 projects beyond the table 7 and is therefore located outside the support region.

At least three sensors 9 located on a reference base (not shown in the Figure) positioned either above or below the region corresponding to the length L' of the plate 8 measure the distance that separates them from the portion of the plate 8 of length L' in order to determine the curvature C thereof. The measurements performed by the sensors 9 are preferably contactless distance measurements in order to avoid falsifying the measurements of the curvature of the portion of the plate 8 of length L'. Use will therefore be made of contactless distance sensors 9, such as eddy current sensors or optical sensors . . .

In order to determine the residual bend $C_r$ of the plate 8 on the basis of the measured curvature C, it is expedient to take into account the curvature $C_p$ of the plate 8 that is due to its dead weight. Knowledge of the following parameters:

length L' of the plate 8 that projects beyond the table 7, determined by a position cell 10, thickness of the plate 8, spacing of the sensors 9 from the table 7, enables the curvature $C_p$ of the plate 8 that is due to its dead weight to be calculated.

Thus, by subtracting the value of the curvature $C_p$ from the value of the measured curvature C, the residual bend $C_r$ of the plate 8 is easily obtained.

Knowing the residual bend $C_r$ of the plate 8, the transfer function is calculated, which then enables the clamping at the outlet (rollers 4*a* and 4*b*) of the planisher 1 to be adjusted in such a manner as to adapt the bend of the following plate 8 to the manufacturer's requirements.

The bend of the plate 8 required by the manufacturer may be zero (absolutely flat plate), positive (upward curvature of the plate) or negative (downward curvature of the plate). In order to obtain plates having one of those profiles, it is expedient either to increase or to decrease the spacing of the rollers 4*a* relative to the rollers 4*b* located at the outlet of the planisher 1.

That operation may be effected by an operator who gathers the various measurements mentioned above and uses those measurements to calculate the transfer function permitting deduction of the clamping parameters, at the outlet, of the rollers 4*a* and 4*b*, which parameters are to be introduced into the adjusting system 11 in accordance with the bend that it is desired to apply to the plate.

That operation may also be effected automatically by a computer.

As soon as the clamping parameters of the rollers 4*a* and 4*b* have been determined, the actuator 12 acts directly on the clamping of the rollers 4*a* and 4*b* at the outlet of the planisher 1, that is to say, on their relative spacing.

The method according to the invention thus permits real-time control of the bend of each of the plates 8. Thus, when the mechanical characteristics of the plate 8 of a reel vary, the real-time control of the bend of the plate 8 makes it possible to act immediately on the clamping parameters at the outlet of the planisher 1 and, if necessary, to modify the clamping adjustments at the outlet (rollers 4*a* and 4*b*) in such a manner as to obtain plates 8, the bend of which is constant or the value of the bend of which remains within the limits of the tolerance set by the manufacturer.

Apart from the advantage mentioned above, the method according to the invention does away with the operations of lifting the plate and measuring the bend by an operator and has the following additional advantages over the prior art:

- improvement in safety conditions;
- elimination of the time spent on handling the plates, thus permitting an increase in the overall productivity of the line;
- rapidity of performing the corrections to the clamping of the rollers, in the case where an automatic computer is used;
- operation for controlling the bend of the plate easy to implement, no restriction to plates of a length less than 3 m for thicknesses of 3 mm as was the case with the method of the prior art;
- gain in space: the device according to the invention is compatible with compact lines and it requires less space than that necessitated by the lifting of the plate;
- systematic control of the bend of all the plates (archiving of values).

Figure 2:
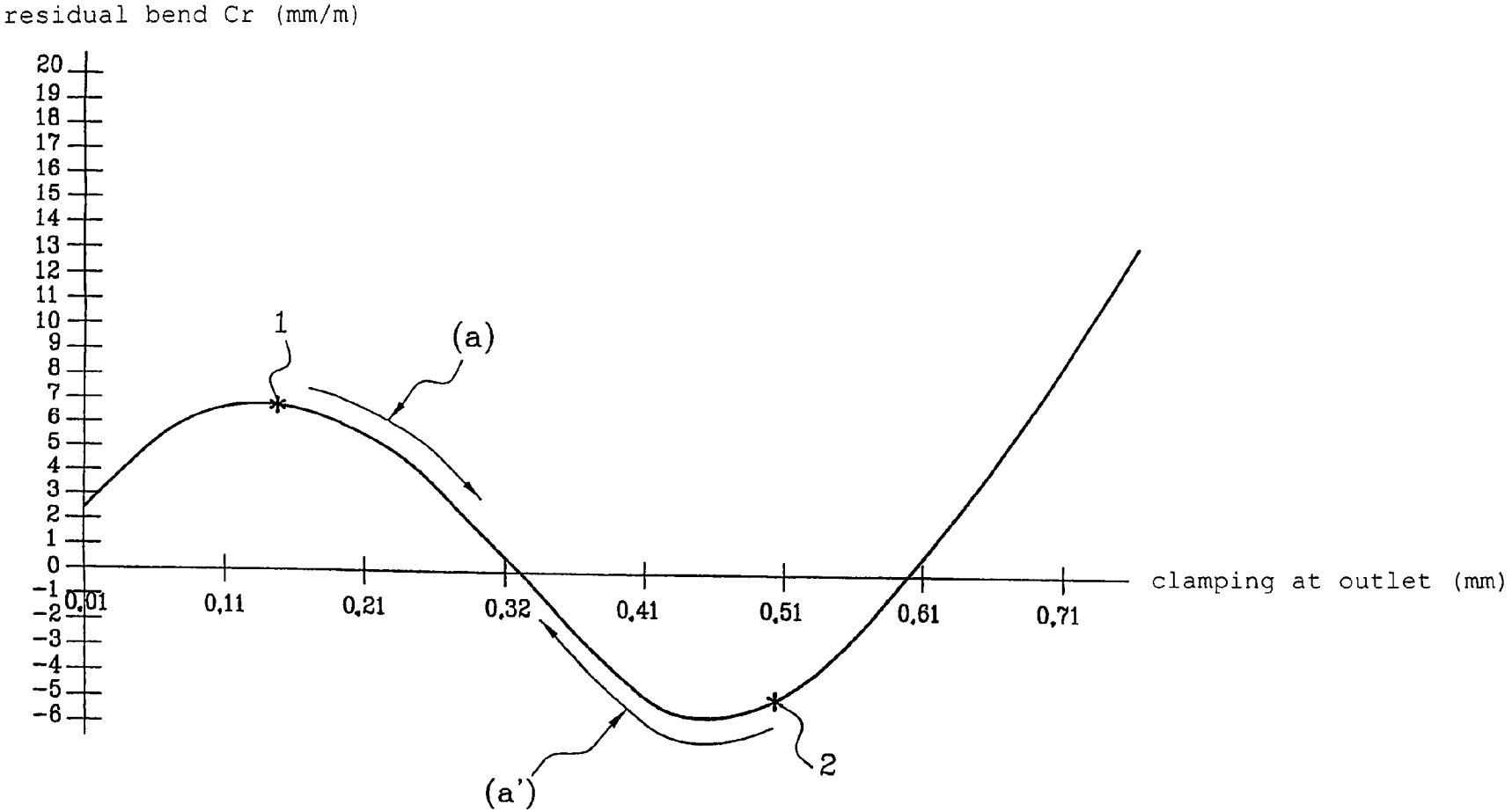
FIG. 2 shows the variation in the value of the residual bend as a function of the clamping of the rollers at the outlet of the planisher.

FIG. 2 shows the variation in the value of the residual bend (expressed in mm/m) as a function of the clamping of the rollers at the outlet of the planisher (expressed in mm).

The material under consideration is a steel strip which is 6 mm thick and 1500 mm wide and which has an elastic limit of 350 Mpa. The initial rate of plasticisation of the strip is 60%. The maximum rate of plasticisation intended for this example is 80%. This set rate of plasticisation depends on the planishing strategy used and on the initial flatness of the strip before planishing. The range of variation in the bend after planishing is directly correlated with that parameter.

The aim of the following Examples is to illustrate the use of the method.

In Example 1, the contactless distance sensors measure a residual bend of the plate obtained after planishing and shearing the steel strip of +7 mm/m. In order to render the bend of this plate zero (absolutely flat plate), it is necessary for the adjusting system (a) to correct the clamping of the rollers at the outlet of the planisher by a correction of 0.15 mm so that the clamping reaches 0.32 mm.

In Example 2, the contactless distance sensors measure a residual bend of the plate obtained after planishing and shearing the steel strip of −7 mm/m. In order to render the bend of this plate zero (absolutely flat plate), it is necessary for the adjusting system (a') to correct the clamping of the rollers at the outlet of the planisher by a correction of 0.2 mm so that the clamping reaches 0.32 mm.

The invention claimed is:

1. A method for adjusting in real time a planisher that is to planish metal strips, plates or sheets, the method comprising:

- planishing a metal strip and then cutting the metal strip to obtain a planished plate;
- measuring, at an outlet of the planisher at an unsupported region of the planished plate, a curvature of the planished plate;
- correcting the measurement to eliminate an influence attributable to a dead weight of the planished plate; and
- adjusting the clamping of rollers located at the outlet of the planisher based upon the measurement to obtain a planished plate having a controlled bend.

2. The method according to claim 1, further comprising determining a residual bend of the planished plate based on the measurement of the curvature of the planished plate the measurement of the curvature of the planished plate being effected by means of at least three distance sensors.

3. The method according to claim 1, wherein a residual bend of the planished plate is deduced from the measured curvature of the planished plate and an inherent curvature of the planished plate.

4. A planishing installation of the type comprising a planisher for planishing metal strips, plates or sheets, the planishing installation comprising:

- means for cutting a metal strip, after planishing the metal strip, into planished plates or planished sheets;
- means for measuring a residual bend of the planished plates or the planished sheets, at an outlet of the planisher; and
- means for modifying the clamping of rollers located at the outlet of the planisher, as a function of information provided by the means for measuring the residual bend,
- wherein the curvature of the planished plates or the planished sheets is measured at an unsupported region of the planished plates or the planished sheets.

5. The planishing installation according to claim 4, wherein the means for measuring the residual bend comprises at least three distance sensors.

6. The planishing installation according to claim 5, wherein the means for measuring the residual bend comprises at least three optical distance sensors.

7. The planishing installation according to claim 5, wherein the means for measuring the residual bend comprises at least three eddy current distance sensors.

8. The planishing installation according to claim 5, further comprising means for automatically adjusting the clamping of the outlet rollers, as a function of the information provided by the distance measurements of the distance sensors.

* * * * *